US005412392A

United States Patent [19]

Tsunekawa

[11] Patent Number: 5,412,392

[45] Date of Patent: May 2, 1995

[54] PORTABLE RADIO UNIT HAVING STRIP ANTENNA WITH PARALLEL TWIN-LEAD FEEDER

[75] Inventor: Koichi Tsunekawa, Kanagawa, Japan

[73] Assignee: NTT Mobile Communications Network, Inc., Tokyo, Japan

[21] Appl. No.: 125,458

[22] Filed: Sep. 23, 1993

[30] Foreign Application Priority Data

Sep. 28, 1992 [JP] Japan ..... 4-258077

[51] Int. Cl.[6] ..... H01Q 1/24; H01Q 11/08

[52] U.S. Cl. ..... 343/702; 343/901; 343/895

[58] Field of Search ..... 343/702, 700 MS, 901, 343/806, 796, 895, 794, 795, 893; H01Q 1/24, 11/08

[56] References Cited

U.S. PATENT DOCUMENTS

| | | | |
|---|---|---|---|
| 3,656,167 | 4/1972 | Lea | 343/793 |
| 4,138,681 | 2/1979 | Davidson et al. | 343/702 |
| 4,313,119 | 1/1982 | Garay et al. | 343/702 |
| 4,847,629 | 7/1989 | Shimazaki | 343/901 |
| 5,177,492 | 1/1993 | Tomura et al. | 343/702 |
| 5,204,687 | 4/1993 | Elliott et al. | 343/702 |

FOREIGN PATENT DOCUMENTS

| | | | |
|---|---|---|---|
| 04-120902 | 4/1992 | Japan | H01Q 13/08 |
| 9216980 | 10/1992 | WIPO . | |

OTHER PUBLICATIONS

"Built-In Antenna for Portable Telephone Set", by K. Yasuhiro, Pat. Abstr. of Japan, vol. 17, No. 264 (E 1370), May 24, 1993.

"Antenna System", by K. Kenichi et al., Pat. Abstr. of Japan, vol. 16, No. 379, (E1247), Aug. 13, 1992.

"Variable Length Whip Antenna", by Y. Isogai, Pat. Abstr. of Japan, vol. 9, No. 244 (E346)(1967), Sep. 30, 1985.

*Primary Examiner*—Donald Hajec
*Assistant Examiner*—Hoanganh Le
*Attorney, Agent, or Firm*—Pollock, VandeSande and Priddy

[57] ABSTRACT

A dielectric plate 21 can be mounted on a housing 11 in such a manner that it is slidably retracted into the housing. A strip antenna element of an electrical length approximately equal to a quarter wavelength is formed on one side of the dielectric plate along one marginal edge thereof, and an antenna element 23 composed of a straight conductor portion 23*a* and a coil 23*b* connected at one end thereto is formed on the dielectric plate 21 just above the strip antenna element 22. The electrical length of the antenna element 23 is also equal to a quarter wavelength. A parallel twin-lead type feeder of a length nearly equal to the quarter wavelength is also formed on the dielectric plate 21 in parallel to the strip antenna element 22. The feeder 26 is connected at one end to inner ends of the antenna elements 22 and 23 and at the other end to a feeder 27 via contact pieces 29*a* and 29*b*. The feeder 27 is connected directly to a radio circuit 12 in the housing 11. When the dielectric plate 21 is at its fully retracted position in the housing 11, the contact piece 29*b* of the plus line 27*b* of the feeder 27 is in contact with the straight conductor portion 23*a* and the contact piece 29*a* of the minus line 27*a* is out of contact with the antenna element 22. The housing 11 is made of a conductive material.

8 Claims, 16 Drawing Sheets

PRIOR ART (X-Y)

PORTABLE RADIO UNIT HAVING STRIP ANTENNA WITH PARALLEL TWIN-LEAD FEEDER

BACKGROUND OF THE INVENTION

The present invention relates to a miniature portable radio unit with a strip antenna and, more particularly, to its antenna and the associated part.

In FIG. 1 there is shown a conventional portable radio unit of this kind, which has a radio circuit 12 enclosed in a housing 11 and a whip type strip antenna 13 put up on the outside of the housing 11. The antenna 13 is connected to the radio circuit 12 via a matching circuit 14 in the housing 11. In general, the matching circuit 12 is needed except when the antenna 13 has an electrical length nearly equal to one-fourth the wavelength at the working frequency of the radio unit.

To obtain an excellent radiation pattern performance, the electrical length of the antenna 13 is preferably be about one-half of the working wavelength. The reason for this is that since a standing wave of a half-wave length gets onto the antenna element, the antenna current is reduced to zero at the site of attachment of the antenna element to the housing and the antenna is essentially free from the influence of the housing. In the conventional portable radio unit, however, the feeding point is at the site of attachment of the antenna element to the housing as referred to above; therefore, it is necessary that feeding to an antenna element whose electrical length is set to the half-wave length be done at a very high impedance—this requires the matching circuit 12. Since the matching circuit 14 is made up of a coil and a capacitor which are lumped parameter elements, their resistance causes a loss, and hence the use of the matching circuit impairs the antenna efficiency about 0.5 to 2 dB.

With the conventional portable radio unit, the above-noted antenna structure provides an excellent radiation pattern almost insusceptible to the influence of the housing but has the defect of decreased efficiency.

Moreover, the use of such a strip antenna makes it difficult to obtain a wide band characteristic. To solve this problem, it has been proposed to modify the matching circuit or load a coil on the antenna element at its tip or intermediate portion, but either method introduces complexity in the construction of the portable radio unit.

Furthermore, in the case where the whip antenna is the retractable type, mismatching occurs at the feeding point when the antenna is at its fully retracted position in the housing, and hence it hardly functions as an antenna, resulting in the gain being seriously impaired.

In view of the above, there has been proposed such a portable radio unit as shown in FIG. 2 (Japanese Patent Laid-Open No. 120902/92). In FIG. 2, reference numeral 15 denotes a dielectric plate which can be retracted down into and extended or projected out upwardly from the housing 11. The dielectric plate 15 has on one side a centrally-disposed strip conductor 16*s* extending lengthwise thereof and on the other side a wider grounding conductor 16*e* extending in opposing relation to the strip conductor 16*e*. The strip conductor 16*s* and the grounding conductor 16*e* constitute a micro strip line 16. Reference numerals 17*a* and 17*b* denote strip conductors connected to both ends of the grounding conductor 16*e* at the side opposite from the housing 11 and extending along both marginal edges of the dielectric plate 15. The electrical lengths of the strip conductors 17*a* and 17*b* are set to a quarter of the wavelength of the working frequency. Reference numeral 18 denotes a coiled conductor connected at one end to the strip conductor 16*s* at the side opposite from the housing 11. The electrical length of the coiled conductor 18 is also set to a quarter of the wavelength of the working frequency.

When the feeding point is located between the connection point of the coiled conductor 1 18 and the strip conductor 16*s* and the connection point of the grounding conductor 116*e* and the strip conductors 17*a* and 17*b*, the antenna current becomes substantially zero at the site of attachment of the antenna element to the housing 11 and the antenna element is not seriously affected by the housing 11 as is the case with the half-wave dipole antenna. When the dielectric plate 15 lies at its fully retracted position in the housing 11, the inner ends of the strip conductors 17*a* and 17*b* and the grounding conductor 116*e* are shorted and the coiled conductor 18 projects out of housing 11, and hence only the coiled conductor 18 functions as an antenna.

With the dielectric plate 15 held at its fully extended position, the antenna operates on the same principle of operation as that of a vertical antenna of the type wherein the center or core conductor of a coaxial cable is projected out therefrom by a quarter-wave length and the outer conductor is folded back by the quarter-wave length to form a cylindrical sleeve. Thus, the antenna characteristic is excellent in a plane containing the surface of the dielectric plate 15 but in a plane perpendicular thereto and containing the strip conductor 16*s* the antenna characteristic is unbalanced and an unbalanced current flows into the housing 11, with the result that the radiation pattern is distorted or disturbed and an energy loss is caused and hence the antenna efficiency is cut down.

Furthermore, the strip conductor 16*s* and the grounding conductor 116*e* of the micro strip line 16 need to be formed on the opposite sides of the dielectric plate 15, i.e. separated by the dielectric plate 15; this poses a problem as a decrease in the thickness of the dielectric plate 15 provides increased loss. The width of the grounding conductor 116*e* is required to be at least approximately three times larger than the width of the strip conductor 16*s*, though dependent on the thickness of the dielectric plate 15, and the strip conductors 17*a* and 17*b* must be provided along both sides of the grounding conductor 16*e*. Thus, the conventional portable radio unit depicted in FIG. 2 has a shortcoming that the width of the dielectric plate 15 is large.

It is therefore an object of the present invention to provide a portable radio unit with an antenna which does not suffer serious distortion or variation of its radiation pattern, has high efficiency and retains a high gain even while the antenna is at its fully retracted position in the housing.

Another object of the present invention is to provide a portable radio unit with an antenna which provides a wide band characteristic with ease as well as the above-mentioned features.

SUMMARY OF THE INVENTION

According to a first aspect of the present invention, there is provided a portable radio unit which includes: a housing; a radio circuit provided therein; a dielectric plate movably secured to the housing, with its top end portion projecting out therefrom at all times; a first strip antenna element formed on the dielectric plate and extending from its lower end portion (at the side of the housing) toward its top end portion, the first antenna element having an electrical length equal to a quarter of the working wavelength (hereinafter referred to as a quarter wavelength); a coiled second antenna element formed on the dielectric plate at the side opposite from the housing with respect to the first antenna element, the coiled second antenna element having an electrical length equal to a quarter wavelength; and a parallel (balanced) twin-lead type feeder formed on the dielectric plate and connected at one end to closely opposed inner ends of the first strip antenna element and the second coiled element and connected at the other end to the radio circuit via a second feeder.

According to another aspect of the invention, the second antenna element is a strip conductor formed in zigzag on the dielectric plate.

According to another aspect of the invention, the first strip antenna and one line of the parallel twin-lead type feeder connected thereto are formed on one side of the dielectric plate and the other line of the feeder is formed on the other side of the dielectric plate.

According to another aspect of the present invention, a third strip antenna element is formed on the dielectric plate in side-by-side relation to the first strip antenna element. The third strip antenna element is different in length from the first strip antenna element and is connected thereto at the side opposite from the housing.

According to another aspect of the invention, the dielectric plate is retractable into the housing and the second feeder and the parallel two-wire feeder make sliding contact with each other. When the dielectric plate is at its fully retracted position in the housing, the second feeder is connected to the parallel twin-lead type feeder near the point of its connection with the first and second antenna elements.

According to another aspect of the invention, the housing is made of a conductive material and when the dielectric plate is at its fully retracted position in the housing, the second feeder is held out of contact with the first antenna element.

According to another aspect of the invention, there is provided means for electrically shorting the inner ends of the parallel twin-lead type feeder when the dielectric plate is held at its fully retracted position in the housing.

According to still another aspect of the invention, the second antenna element is extended in a direction opposite from the first antenna element so that the former has about the same length as the that of the latter.

In the portable radio unit of the present invention, the first antenna element has an electrical length substantially equal to the quarter wavelength, the second antenna element is formed by a coiled or zigzag conductor and the feeding point impedance is low. By matching the characteristic impedance of the parallel twin-lead type two-wire feeder with the feeding point impedance, no matching circuit is needed to connect the antenna to the radio circuit; consequently, there will be no loss by the matching circuit and the radio unit will not become bulky or large accordingly. The entire antenna length may also be kept shorter than the half-wave length.
shorter than the half-wave length.

The provision of the first and second antenna elements yields two resonance points, making it possible to obtain a wide band characteristic. Furthermore, when the antenna is received or held at its fully retracted position in the housing, the second antenna elements provides a relatively large antenna gain.

DESCRIPTION OF THE PREFERRED EMBODIMENTS

Figure 1:
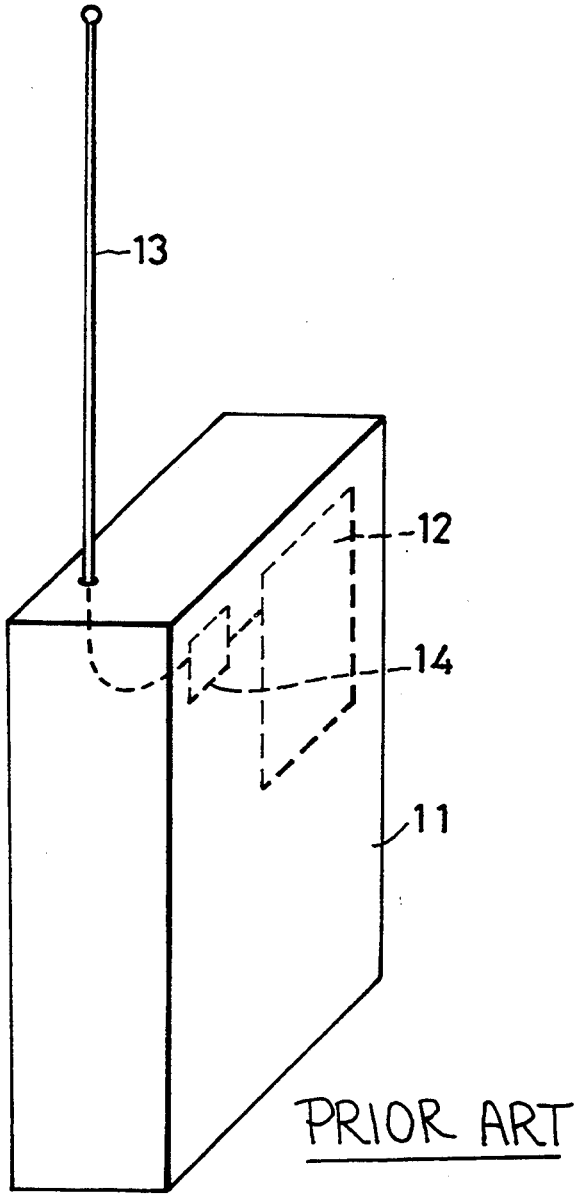
FIG. 1 is a perspective view showing a conventional portable radio unit.
Figure 3:
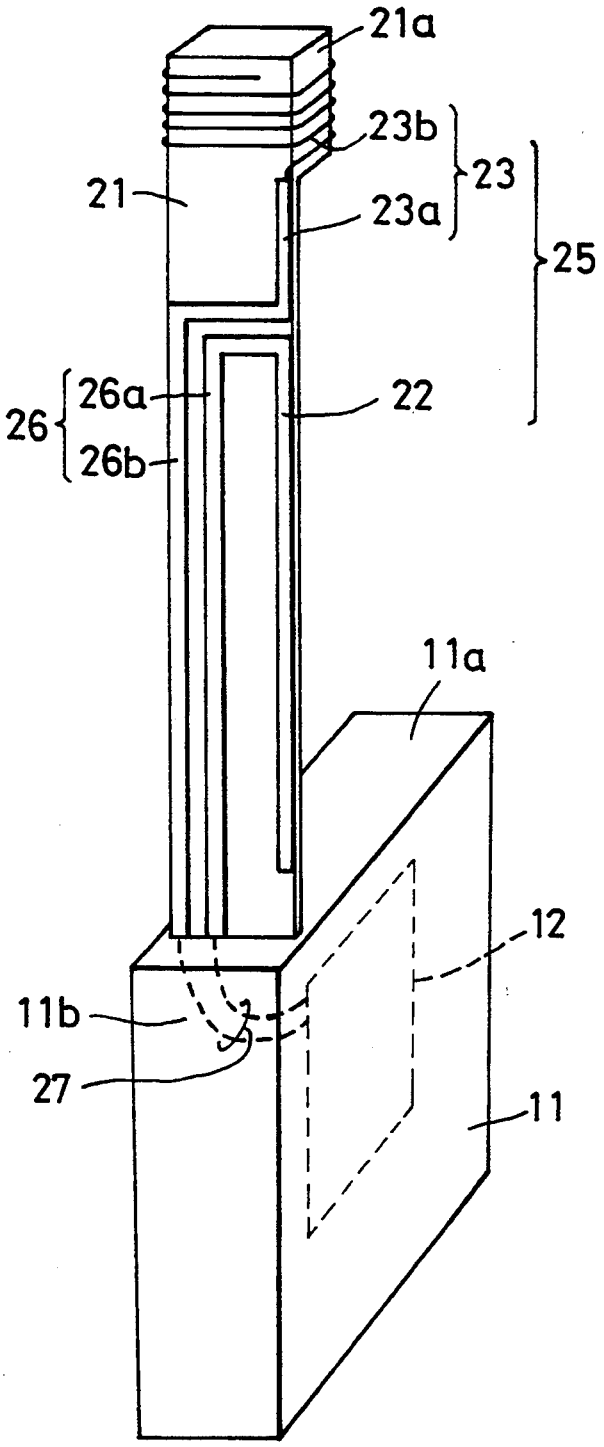
FIG. 3 is a perspective view illustrating an embodiment of the present invention.

FIG. 3 illustrates, in perspective, an embodiment of the present invention, in which the parts corresponding to those in FIG. 1 are identified by the same reference numerals. As in the prior art example, the housing 1 is a relatively thin square box, in which the radio circuit 12 is enclosed.

In the present invention, a dielectric plate 21 is protrusively provided on the housing l while being secured at one end thereto. In this embodiment the dielectric plate 21 has a width smaller than the thickness of the housing 11 and is planted upright on the top 11*a* of the housing 11 at one end portion thereof. The dielectric plate 21 is made of a material of a low dielectric loss, such as fluorine resin, and remains straight by itself, but it need not necessarily be rigid and may also be flexible. On one side of the dielectric plate 21 there is formed a first strip antenna element 22 that extends from one end at the side of the housing 11 toward the other end of the plate 2. A second antenna element 23 is provided on the dielectric plate 21 at the side opposite from the housing 11 with respect to the first strip antenna element 22. In this embodiment the second antenna element 23 is composed of a straight conductor portion 23*a* formed on the dielectric plate 2 substantially in alignment with the first strip antenna element 22 and a coil 23*b* connected to the straight conductor portion 23*a* at the side opposite from the first strip antenna element 23. The straight conductor portion 23*a* is appreciably shorter than the first strip antenna element 22 and is disposed close thereto. In this embodiment the first strip antenna element 22 and the straight conductor portion 23*a* are formed on one side of the dielectric plate 21 along its one marginal edge. The free end portion of the dielectric plate 21 at the side opposite from the housing 11 has an increased thickness to form a thick end portion 21a, on which the coil 23*b* is wound. The sum of the electrical lengths of the straight conductor portion 23*a* and the coil 23*b*, that is, the electrical length of the second antenna element 23 is chosen substantially equal to the electrical length of the first strip antenna element 22. The first strip antenna element 22 and the second antenna element 2B constitute a half-wave dipole antenna 25. In this example the electrical length of the first strip antenna element 22 is approximately equal to a quarter wavelength.

Extending in side-by-side relation to the first strip antenna 22 is a parallel twin-lead type feeder 26 formed on the dielectric plate 21 and connected at one end to a feeding point of the dipole antenna 25; that is, lines 26*a* and 26*b* of the parallel twin-lead type feeder 26 are connected at one end to inner ends of the first strip antenna element 22 and the straight conductor portion 23*a*, respectively. The parallel twin-lead type feeder 26 is shown to extend along the other marginal edge of the dielectric plate 2 on the same side as that where the first strip antenna 22 is provided. The characteristic impedance of the parallel twin-lead type feeder 26 is chosen nearly equal to the feeding point impedance of the dipole antenna 25. The other end of the parallel two-wire feeder 26 is connected via a second feeder 27 to the radio circuit 12 at the side of the housing l. In this example no matching circuit is used. The feeding impedance of a half-wave whip antenna at the center thereof is as low as about 75 Ω, and input impedances of a filter and a receiver, which are ordinary internal circuits of the radio unit, are also as low as around 50 Ω. Hence, no matching circuit is needed in the case where the center of the whip antenna is connected to the internal circuits via the parallel twin-lead type feeder 26 of a low characteristic impedance and the second feeder 27 as in this embodiment.

Such a structure as described above permits feeding to the half-wave dipole antenna 25 without using a matching circuit. Since the antenna 25 has a half-wave electrical length, the antenna current is reduced at the lower end of the antenna 25 near the housing 11 and the antenna 25 is not greatly influenced by the housing 11, and hence an excellent radiation pattern characteristic can be obtained; moreover, since no matching circuit is used, no loss is caused and the antenna efficiency is less impaired. Furthermore, the antenna is formed flat, and hence can be fabricated relatively easily, and it can also be made flexible like an ordinary whip antenna.

Figure 4A:
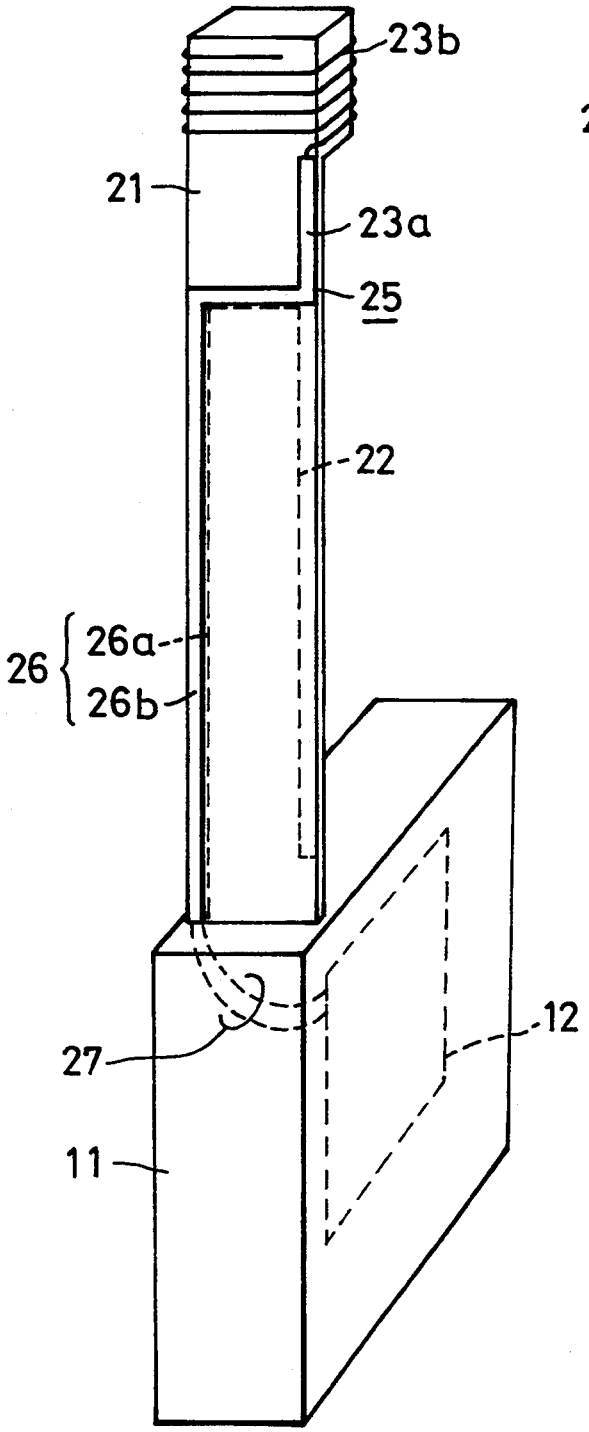
FIG. 4A is a perspective view illustrating a modified form of the FIG. 3 embodiment in which two lines of a parallel two-wire feeder are each formed on one side of a dielectric plate.
Figure 4B:
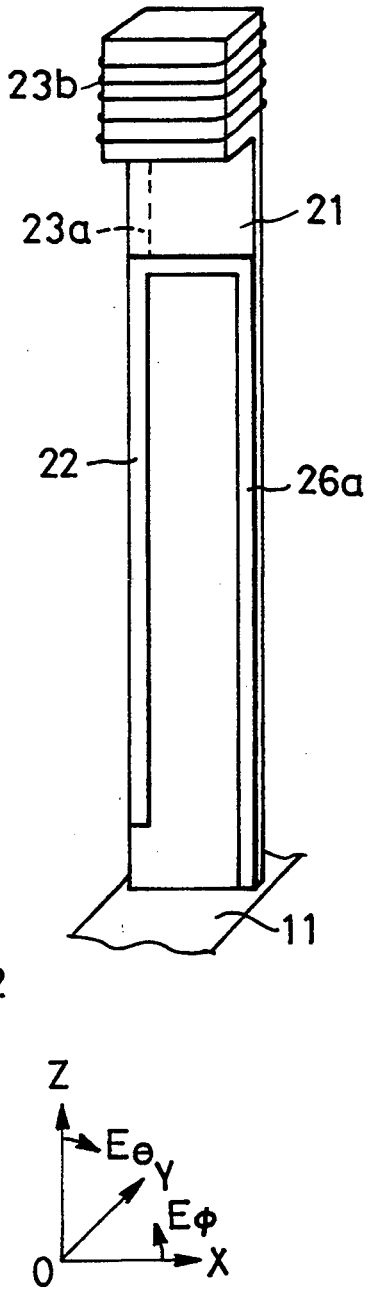
FIG. 4B is a perspective view, partly cut away, showing the other side of the dielectric plate.

FIG. 4 illustrates a modified form of the FIG. 3 embodiment, in which the parts corresponding to those in FIG. 3 are identified by the same reference numerals. In this embodiment the first strip antenna element 22 is formed on one side of the dielectric plate 21 , the straight conductor portion 23*a* is formed on the other side of the dielectric plate 2, the line 26*a* of the parallel twin-lead type feeder 26 is formed on the same side of the dielectric plate 2 as the first strip antenna element 22, and the line 26*b* of the feeder 26 is formed on the same side of the dielectric plate 21 as the straight conductor portion 23*a* in opposed relation to the line 26*a* through the dielectric plate 21.

Figure 5A:
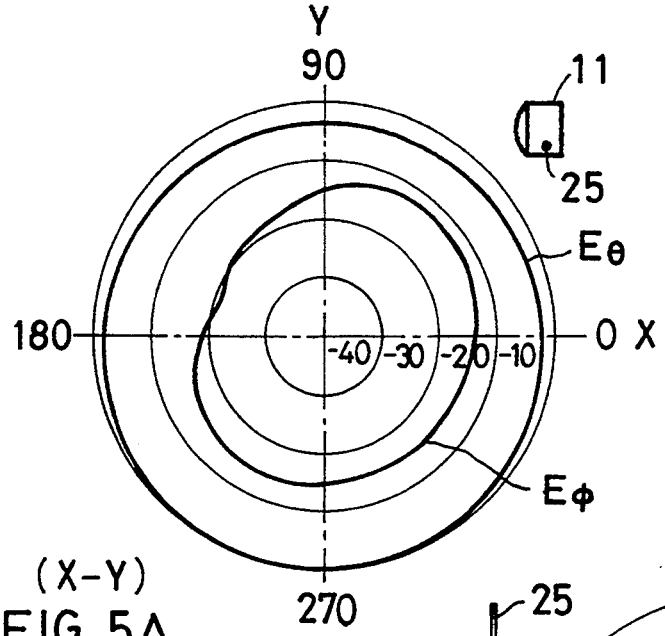
FIG. 5 shows a series of radiation pattern characteristics measured on the embodiment depicted in FIG. 4, FIG. 5A showing characteristics in the X-Y plane, FIG. 5B characteristics in the Y-Z plane and FIG. 5C characteristics in the X-Z plane.
Figure 5B:
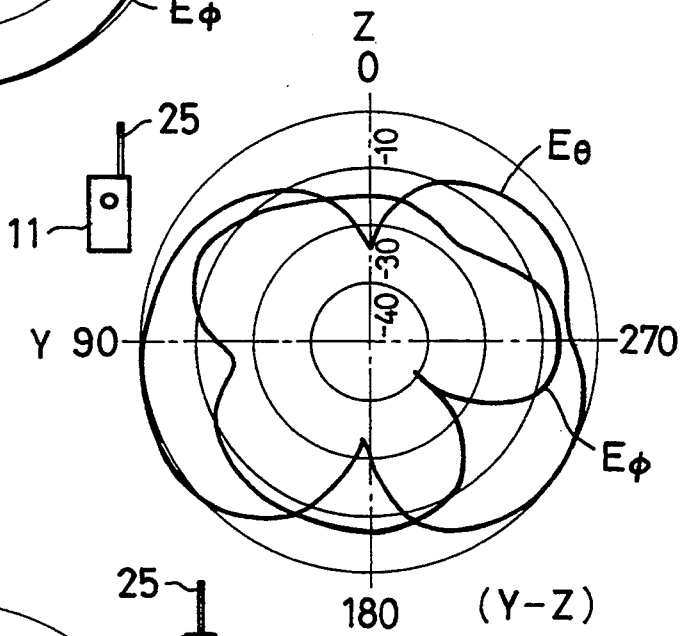
Figure 5C:
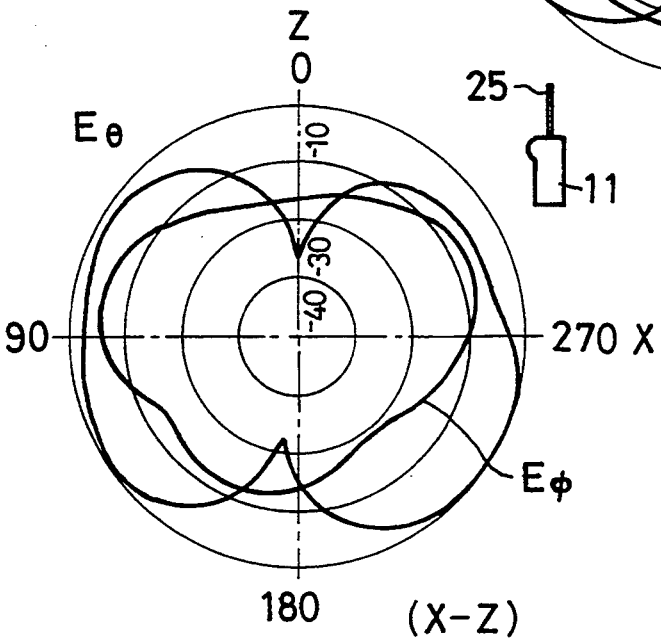

It will readily be understood that this embodiment also provides the same favorable results as those obtainable with the FIG. 3 embodiment. Measurements of radiation characteristics were made on the FIG. 4 embodiment, in which the dielectric plate 2 was 12 cm long, 0.5 cm wide and 0.1 cm thick and had a dielectric constant of about 2; the straight conductor portion 23*a* was 1.7 cm long; the first strip antenna element 22 was 7.7 cm long and 0.1 cm wide, the coil 23*b* was 0.6 cm in diameter and 4 in the number of turns; the housing 11 had a size measuring a length of 11 cm by a width of 5 cm by a thickness of 2.5 cm; and the line 26*a* and the first strip antenna element 22 were spaced 0.4 cm apart. FIG. 5 shows the results of the measurements. The frequency at which the measurements were carried out was 904 MHz, which was the resonance frequency of the antenna 25. In FIG. 5, 0 dB is the peak level (about 2.15 dBi) of a straight type half-wave dipole antenna. In the coordinate system shown in FIG. 4, the X axis is aligned with the widthwise direction of each of the housing 11 and the dielectric plate 21, the Y axis is aligned with a direction perpendicular to the surface of the dielectric plate 21 and the Z axis is aligned with the lengthwise direction of each of the dielectric plate 21 and the antenna 25, and electric fields in terms of polar coordinates are indicated by $E_\theta$ and $E_\phi$, that is, $E_\Theta$ is substantially perpendicular to the XY plane in orthogonal coordinates and $E_\phi$ substantially perpendicular to the ZY plane. FIG. 5A shows radiation patterns in the XY plane, FIG. 5B radiation patterns in the YZ plane and FIG. 5C shows radiation patterns in the XZ plane. As will be seen from FIGS. 5B and 5C, peaks of the radiation patterns are somewhat deflected toward the housing 11, but peak levels in FIGS. 5A and 5B exceed that (0 dBd) of the dipole antenna about 1 dB, indicating high radiation efficiency. An increase of about 1 dB in gain is very significant in a portable radio unit of this kind. The radiation patterns depicted in FIG. 5A are substantially non-directional, whereas the radiation patterns $E_\Theta$ in FIGS. 5B and 5C are figure-8 patterns, which are close to the radiation pattern of an ordinary dipole antenna. Thus, the radiation pattern of the antenna 25 is not seriously distorted and a high antenna efficiency can be obtained.

Figure 6:
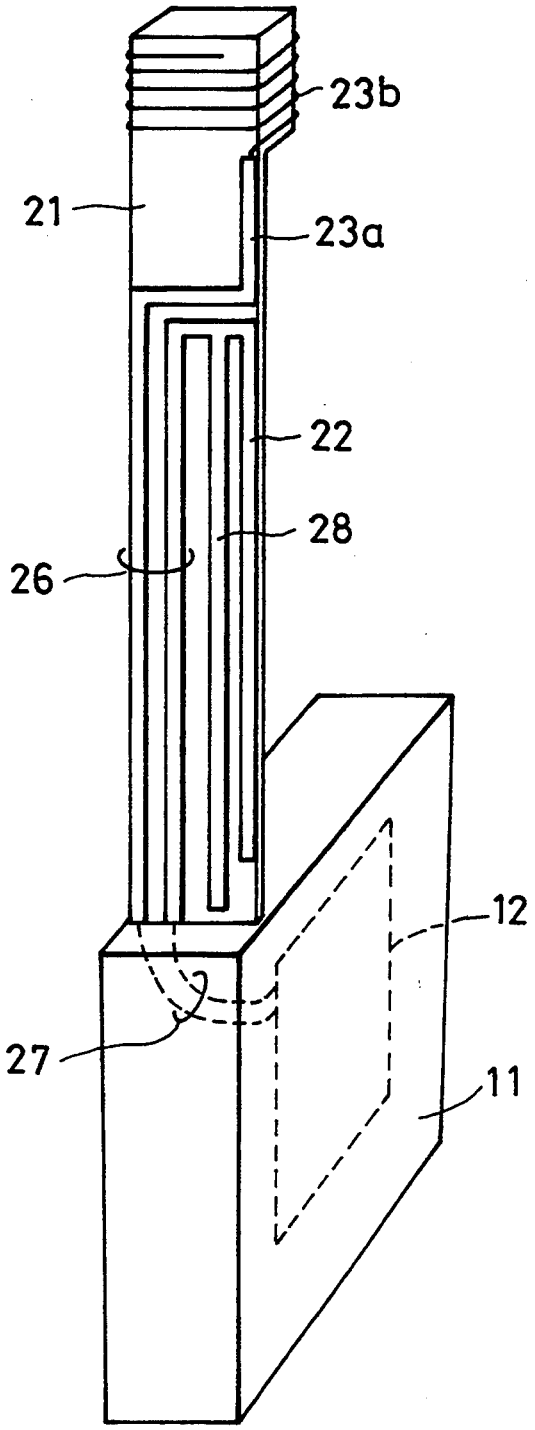
FIG. 6 is a perspective view illustrating another embodiment of the present invention which has a third antenna element.

FIG. 6 illustrates another embodiment of the present invention which is intended to obtain a wide band characteristic, the parts corresponding to those in FIG. 3 being identified by the same reference numerals. In this embodiment a third strip antenna element 28, different in length from the first strip antenna element 22, is formed on the dielectric plate 21 in side-by-side relation to the first strip antenna element 22, to which the third strip antenna element 28 is connected at the side opposite from the housing 11. The electrical lengths of the first and third strip antenna elements 22 and 28 are adjusted to $\pm 10\%$ of one-fourth of wavelengths $\lambda_1$ and $\lambda_2$ at the resonance frequency desired to obtain. The sizes of the respective parts in this embodiment are the same as those mentioned above in respect of FIG. 2. The first and third antenna elements 22 and 28 are spaced about 2 mm apart.

Figure 7:
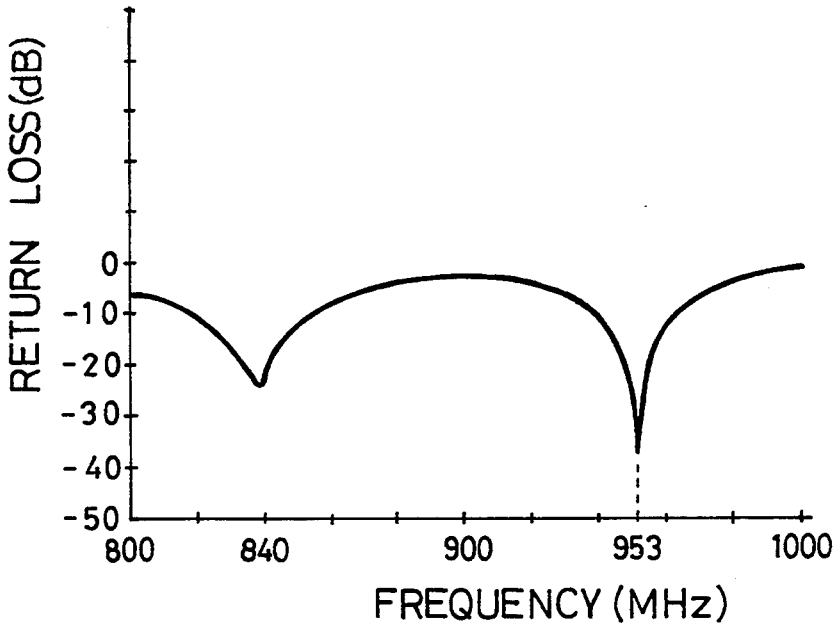
FIG. 7 is a graph showing the return-loss frequency characteristic measured on the FIG. 6 embodiment.

FIG. 7 shows the resonance characteristic of this embodiment measured in the case where the dielectric constant of the dielectric plate 21 was 4, the respective lines were 0.0.4 cm wide, the first and third strip antenna elements were 5.8 cm and 6.7 cm long, respectively, and the other dimensions were the same as the parameters used in the FIG. 4 embodiment. As will be seen from FIG. 7, the antenna resonates at 840 and 953 MHz, presenting a two-band characteristic; therefore, a wide band characteristic can be obtained by selecting the lengths of the first and third strip antenna elements to reduce the difference between the both resonance frequencies.

Figure 8A:
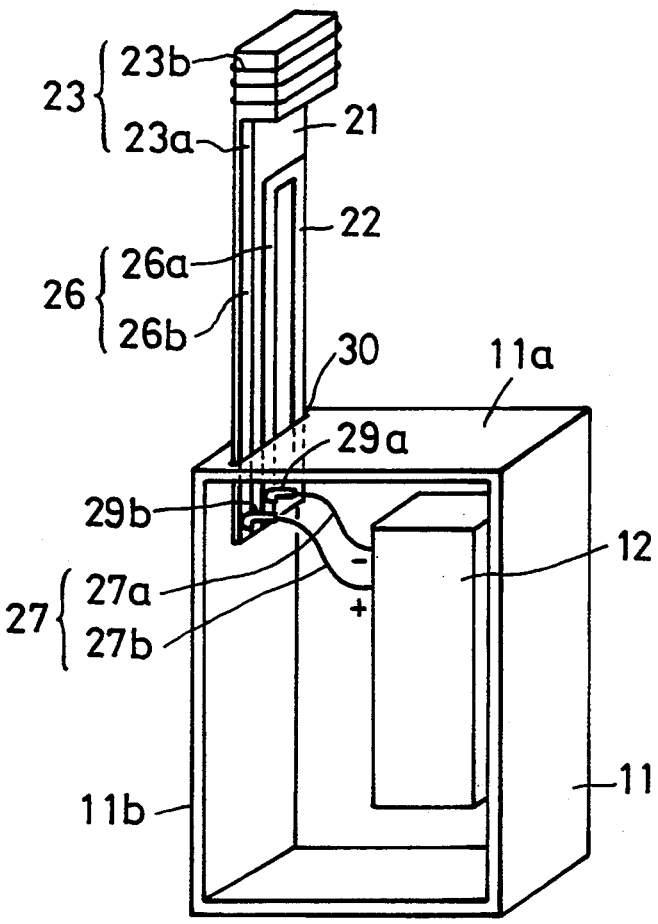
FIG. 8 is a perspective view illustrating another embodiment of the present invention in which the dielectric plate is retractable into a housing, FIG. 8A showing the inside of the housing with the antenna held at its fully extended position and FIG. 8B the inside of the housing with the antenna received and held at its fully retracted position therein.

FIG. 8 illustrates another embodiment of the present invention in which the antenna can be retracted into the housing. In this embodiment the dielectric plate 21 is adapted to be retracted into the housing 11. As shown in FIG. 8A, the housing 11 has in its top panel 11*a* a slit 30, through which the dielectric plate 21 is slid down into housing 11 in parallel to its side panel 11*b*. In the housing 11 there are contact pieces 29*a* and 29*b* which make elastic contact with the lines 26*a* and 26*b* of the parallel twin-lead type feeder 25, respectively, and the second feeder 27 is connected to the parallel twin-lead type feeder 26 via the contact pieces 29*a* and 29*b*. The straight conductor portion 23*a* of the second antenna element 23 is formed contiguous to the line 26*b*. Of lines 27*a* and 27*b* forming the second feeder 27, the line 27*b* connected to the line 26*b* is connected to the plus side of the radio circuit 12 and the line 27*a* is connected to the minus side (or the grounding side) of the radio circuit 12.

Figure 8B:
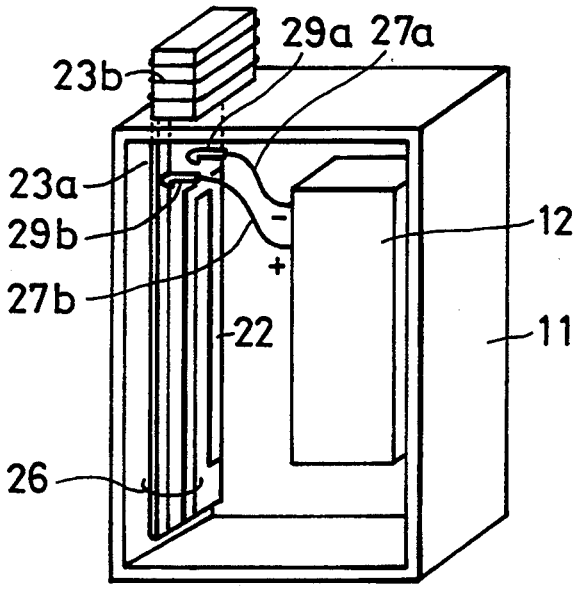

The depth of retraction of the dielectric plate 21 into the housing 11 is chosen such that when it is at its fully retracted position in the housing 1, the contact piece 29*a* is out of contact with the line 26*a* and the contact piece 29*b* remains in contact with the straight conductor portion 23*a*, as shown in FIG. 8B. The thick end portion 21*a* of the dielectric plate 21 is not allowed to pass through the slit 30 but rests on the top panel la of the housing l so that the dielectric plate 21 can easily be pulled out of the housing 11.

When the dielectric plate 2 is retained at its fully retracted position in the housing 11, and the contact piece 29*a* is out of contact with the line 26*a*, no power is fed from the minus line 27*a* side of the second feeder 27 to the antenna but in the radio circuit 2 the minus side is connected to the housing 11 made of a conductive material. That is, as viewed from the radio circuit 12, the plus side is connected to the second antenna element 23 and the minus side is connected to the housing 11. Thus, the second antenna element 23 has an electrical length substantially equal to a quarter wavelength, and hence operates as a monopole antenna on the housing 11.

Figure 9A:
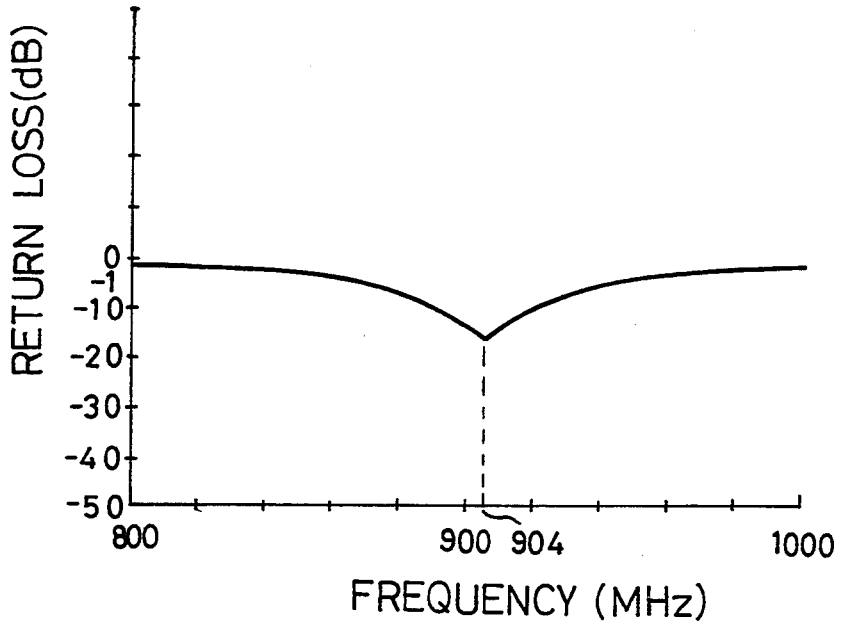
FIGS. 9A and 9B are graphs showing return-loss characteristics measured on the FIG. 18 embodiment.
Figure 9B:
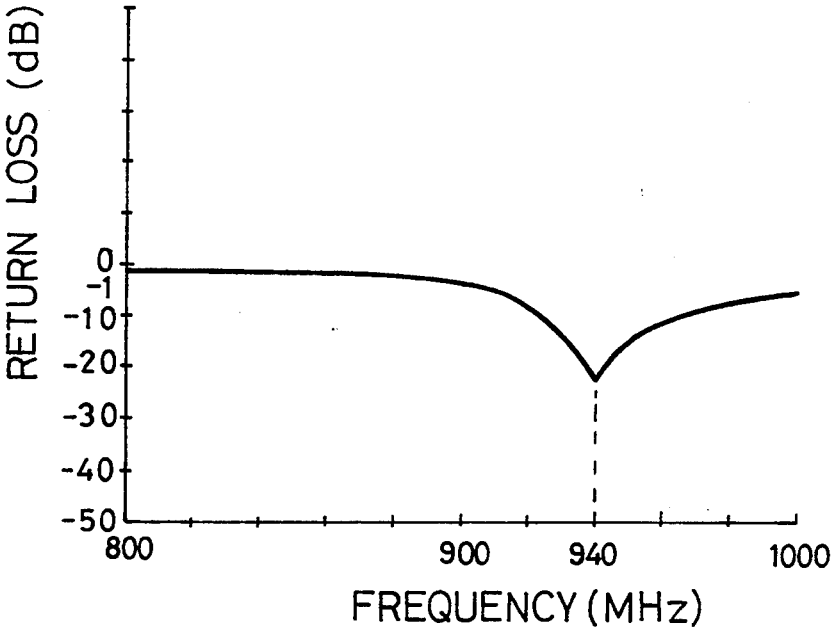
Figure 10A:
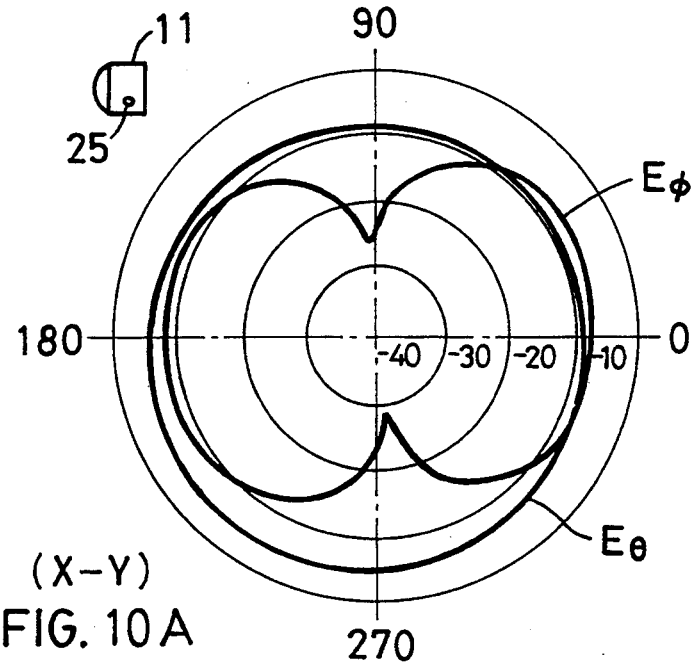
FIG. 10 shows radiation pattern characteristics measured on the FIG. 18 embodiment with the antenna received in the housing as shown in FIG. 8B, FIG. 10A showing characteristics in the X-Y plane and FIG. 10B characteristics in the Y-Z plane.
Figure 10B:
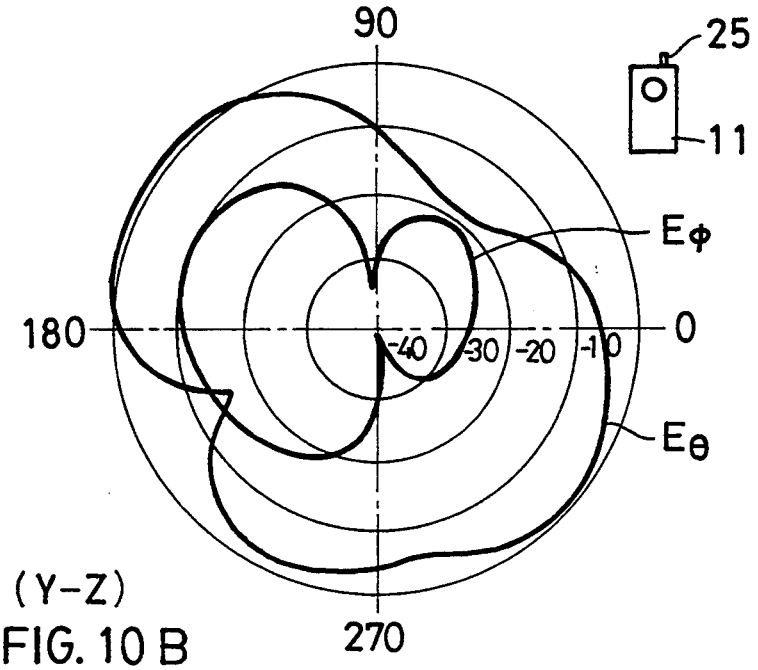

Measurements of return-loss characteristics were made on the FIG. 8 embodiment in the cases where the dielectric plate 21 was held at its fully extended position outside the housing 11 and where the dielectric plate 21 was held at its fully retracted position in the housing 11 and the plus side 27*a* of the second feeder 27 was connected to the straight conductor portion 23*a* 1 cm above the point of its connection to the parallel twin-lead type feeder 26. The antenna system and the housing in the measurements were the same as those used in the experiments mentioned above with respect to the FIG. 5 embodiment. FIGS. 9A and 9B show the return-loss characteristics thus measured. With the dielectric plate 21 held at its fully extended position outside the housing 11, the antenna resonates at 904 MHz, whereas when the dielectric plate 21 is retained at its retracted position in the housing 11 the antenna resonates with 940 MHz. In FIG. 10 there are shown radiation characteristics measured with the dielectric plate 21 held at its fully retracted position. The horizontal directional pattern of the electric field vector E (FIG. 10A) is non-directional and the gain is also appreciably large. The vertical directional pattern (FIG. 10B) considerably deviates from the figure-8 pattern owing to the influence of the housing but the gain is large-this indicates a sufficient radiation.

Figure 11A:
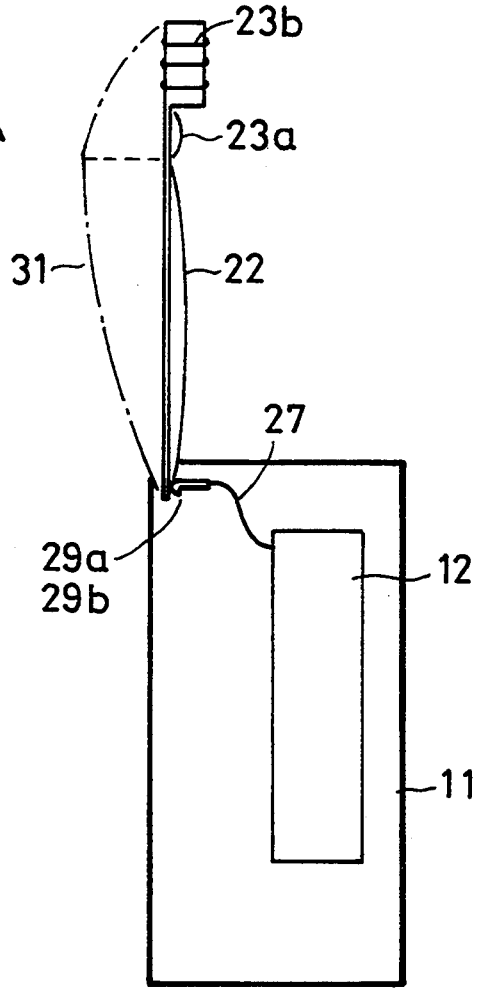
FIGS. 11A and 11B are diagrams showing antenna current distributions in the FIG. 18 embodiment with the antenna held at its fully extended position and retracted position as shown in FIGS. 8A and 8B, respectively.
Figure 11B:
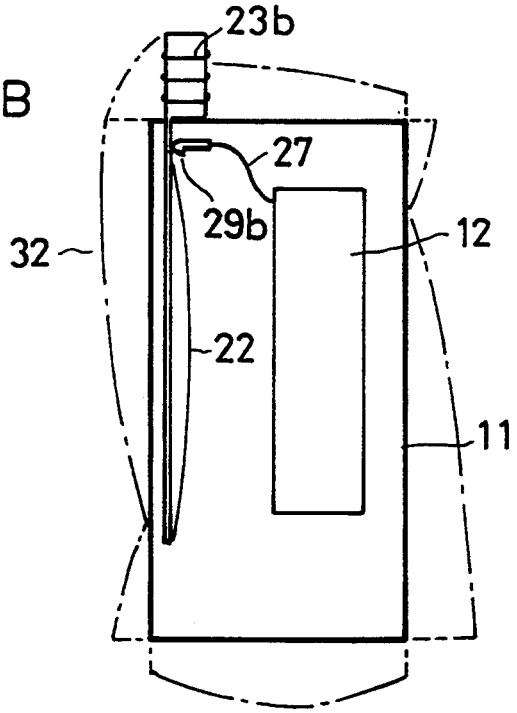

FIG. 11 is explanatory of the principle of operation of the embodiment shown in FIG. 8. When the dielectric plate 21 is at its fully extended position, the current distribution is such as indicated by the curve 31 in FIG. 11A, that is, current flows in the first and second antenna elements 22 and 23 and is maximum at the feeding point and zero at both ends of the antenna. Thus, current is fed from the lower end of the dielectric plate 21 but transmitted over the parallel twin-lead type feeder 26 to the center of the current distribution 31, and hence is fed at a low impedance. When the dielectric plate 21 is at its fully retracted position, current is distributed over the second antenna element 23 and the casing 11 as indicated by the curve 32 in FIG. 11B, and since the feeding point is just at the center of the antenna 25, current is fed intact. Consequently, matching is always maintained regardless of whether the dielectric plate 2 is at its fully extended or retracted position, providing a high gain. In this instance, however, since current is distributed all over the housing 11, the current distribution appreciably deviates from that of the half-wave dipole antenna 25, resulting in the radiation pattern becoming deformed as depicted in FIG. 10B. Incidentally, in the case where the contact piece 29*a* is connected to the line 26*a* near the first strip antenna element 22 when the dielectric plate 21 is at its retracted position in the housing 11, even if the housing 11 is made of a nonconductive material, the antenna current flows in the first and second antenna elements 22 and 23 as in the case of FIG. 1A and they radiate an electric wave through the non-conductive casing 11; hence, they serve as an antenna. On the other hand, when the casing 1 is made of a conductive material, current flows in the antenna since the contact piece 29a is in contact with the line 23a, but the antenna element 22 in the housing does not radiate an electric wave. In consequence, current on the casing radiates as in the case of FIG. 11B—this is the same as in the case where the contact piece 29a is out of contact with the line 26a.

Figure 12:
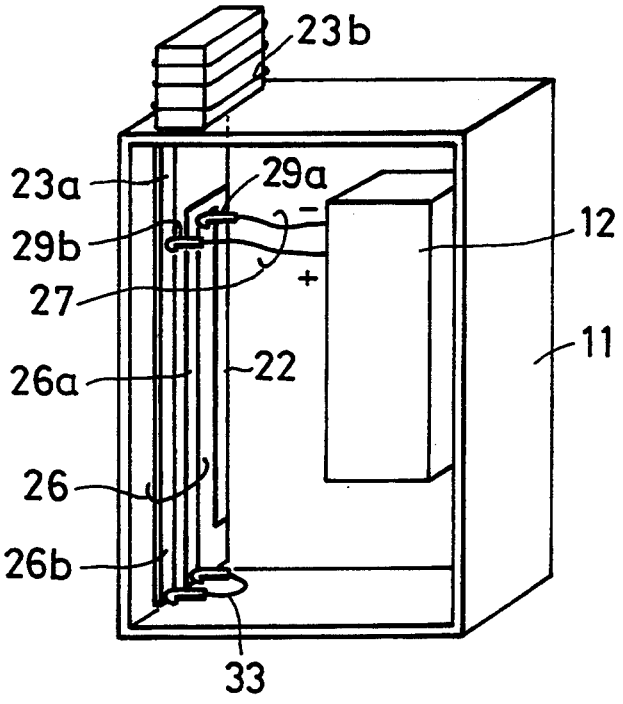
FIG. 12 is a perspective view showing the inside of the housing of another embodiment of the invention, with the antenna received at its fully retracted position.

FIG. 12 illustrates a modified form of the embodiment of FIG. 8, in which when the dielectric plate 2 is at its fully retracted position in the housing l, the inner ends of the parallel twin-lead type feeder 26 are in elastic contact with a shortcircuit piece 33 while at the same time holding its line 26a in contact with the contact piece 29a. With such a construction, also when the dielectric plate 21 is at the retracted position in the housing 11, the plus line 27b of the second feeder 27 is connected to the quarter-wave monopole antenna formed by the straight conductor portion 23a and the coil 23b, and as a result, matching is obtained. Moreover, since the inner ends of the parallel twin-lead type feeder 26 are shorted and since the length of the feeder 26 is approximately equal to the quarter wavelength, the impedance at the parallel twin-lead type feeder 26 side as viewed from the feeding point, that is, from the contact pieces 29a and 29b, is infinity and no current flows to the parallel twin-type lead feeder 26 side.

Figure 13:
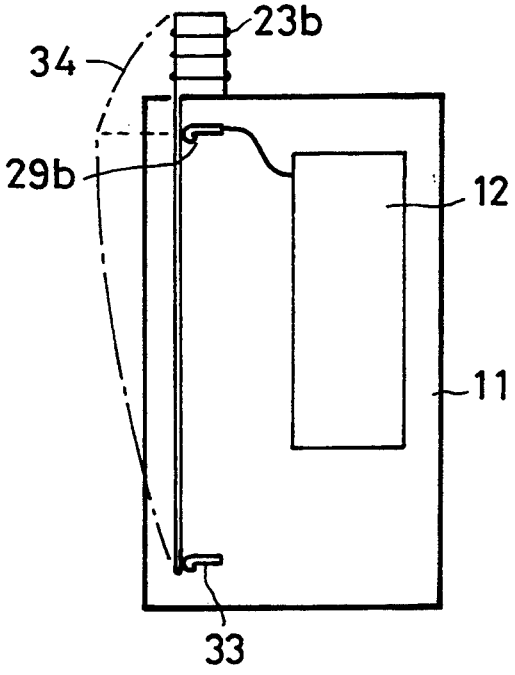
FIG. 13 is a diagram showing the antenna current distribution in the FIG. 12 embodiment.

In FIG. 13 there is indicated by the curve 32 the current distribution when the housing 11 is made of a nonconductive material in this case. As will be seen from FIG. 13, the antenna functions as a half-wave dipole antenna. Also in this instance, if the housing 11 is made of conductive material, current flows in the antenna element 23 and the housing 11 when the dielectric plate 21 is at the retracted position in the housing and hence they perform the function of an antenna.

Figure 2:
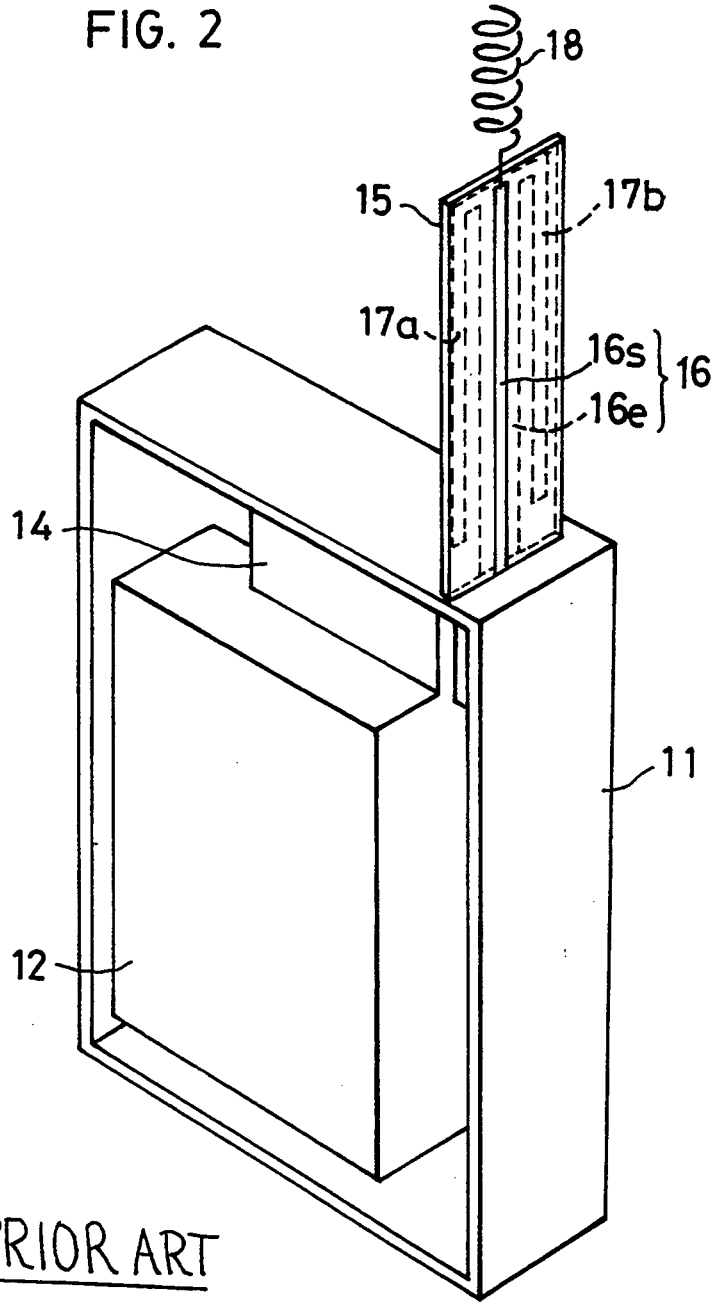
FIG. 2 is a perspective view showing another conventional portable radio unit improved from that of FIG. 1.
Figure 14:
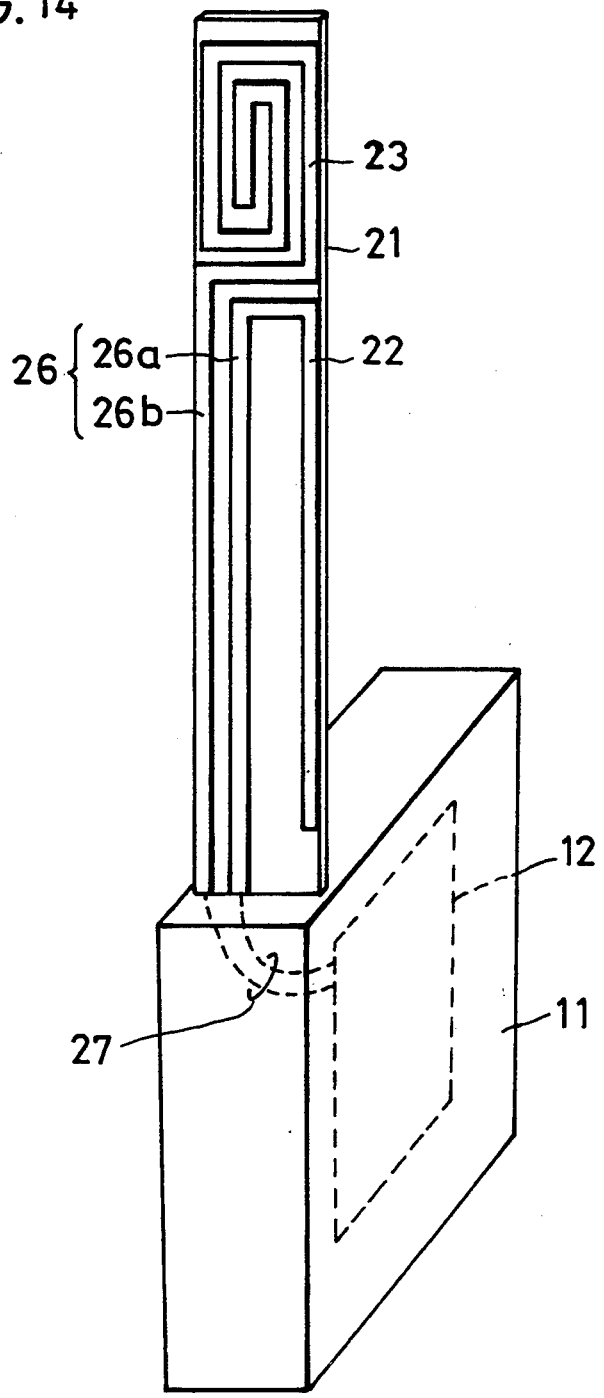
FIG. 14 is a perspective view illustrating another embodiment of the present invention wherein a second antenna element is formed by a spiral conductor.
Figure 15:
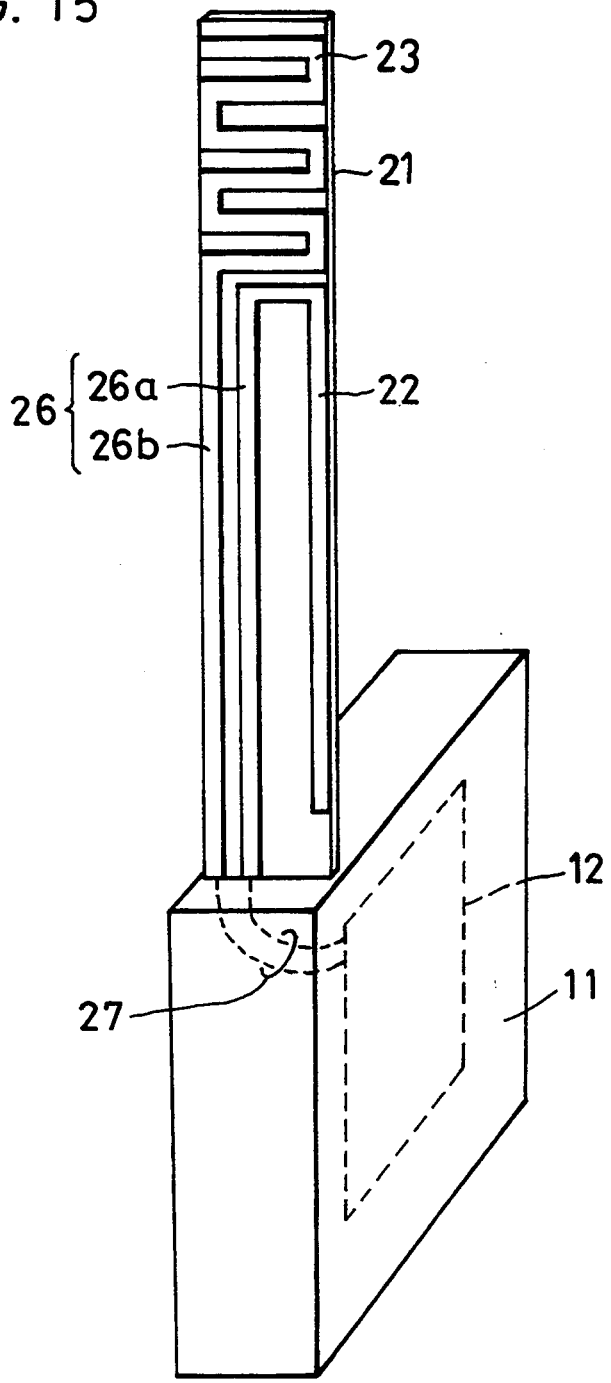
FIG. 15 is a perspective view illustrating another embodiment of the present invention wherein the second antenna is formed by a zigzag conductor.

The second antenna element 23 in the embodiment of FIG. 3 may also be provided in the form of a spiral coil as shown in FIG. 14 or in the form of a zigzag conductor as shown in FIG. 15. Also in the embodiments of FIGS. 14 and 15, the lines 26a and 26b of the parallel twin-lead type feeder 26 may be formed on the one and the other side of the dielectric plate 21, respectively, as depicted in FIG. 2; the third strip antenna element 28 may be juxtaposed with the first strip antenna element 22 as shown in FIG. 6; and the dielectric plate 21 may be made retractable into the housing 11 as shown in FIG. 8, in which case provision may also be made for shorting the inner ends of the parallel twin-lead type feeder 26 when the dielectric plate 21 is at its fully retracted position in the housing 1, as described above in conjunction with FIG. 12.

Figure 16:
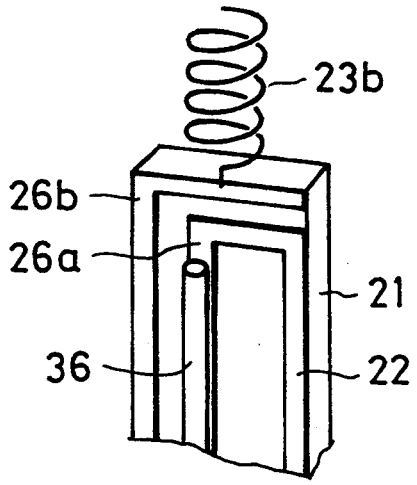
FIG. 16 is a perspective view illustrating another embodiment of the present invention wherein the second antenna is formed by a coil.
Figure 17:
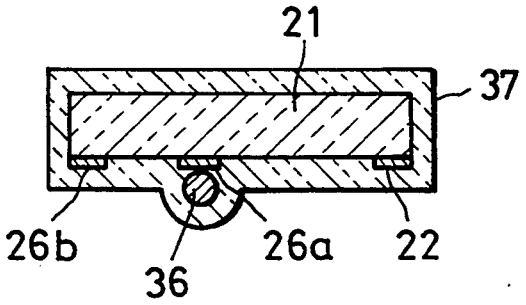
FIG. 17 is an enlarged cross-sectional view of the dielectric plate, showing its modified version covered with a protective layer.

At any rate, it is possible to employ a construction in which, when retracted into the housing 11, the dielectric plate 21 is positioned by a stopper, for example, by the bottom panel of the housing 11, so that the second antenna element 23 mostly remains outside of the housing 11. As shown in FIG. 16, the second antenna element 23 may be formed as a cylindrically coiled, self-supporting conductor member, which is fixedly secured at one end to the line 26b of the parallel twin-lead type feeder 26 on the dielectric plate 21. In this case, as depicted in FIG. 16, a thin reinforcement wire 36 of 0.5 mm diameter, for example, may be fixed along the line 26a over the entire length thereof to mechanically reinforce the dielectric plate 21. The dielectric plate 21 may be covered entirely with a dielectric protective layer 37 as depicted in FIG. 17. The protective layer 37 can be provided by molding a dielectric material, for example. In this instance, the second antenna element 23 is also covered with the protective layer 37. The reinforcement of the dielectric plate 21 by the reinforcement wire 36 and the protection by the protective layer 37 are also applicable to the embodiments of FIGS. 2, 6, 8, 14 and 15.

In the above embodiments, the straight conductor portion 23a of the second antenna element 23 is provided to permit easy soldering of the coiled portion 23b with pratically no hindrance by the first antenna element 22; hence, the straight conductor portion 23a need not always be provided.

Figure 18:
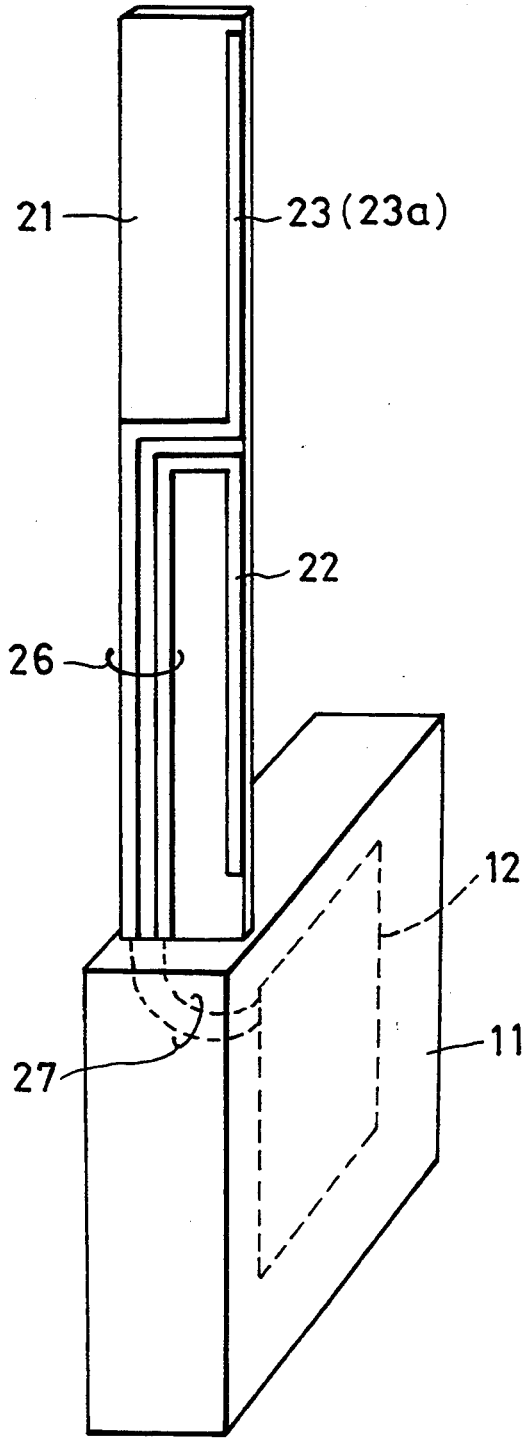
FIG. 18 is a perspective view illustrating still another embodiment of the present invention wherein the second antenna element is formed by a quarter wave conductor.

FIG. 18 illustrates another embodiment of the present invention in which the coil 23b is omitted but instead the straight conductor portion 23a is extended to the same length as that of the first antenna element 22, that is, the second antenna element 23 is also used as a quarter-wave antenna. With the structure of this embodiment, the antenna becomes longer but the radiation pattern characteristic or directional pattern is improved. Also in this case, provision may be made for retracting the lower half of the dielectric plate 21 into the housing 11.

As described above, according to the present invention, since the second antenna element 23 is provided as a coil or in zigzag form, the total antenna length can be reduced. Moreover, since the antenna 25 functions as a half-wave dipole antenna and since its low-impedance feeding point is connected via the parallel twin-lead type feeder 26 to the second feeder 27, no matching circuit is needed to connect the antenna to the radio circuit 12. Thus, the radio unit of the present invention is free from the loss by a matching circuit, high in antenna efficiency and small in size. Besides, current on the antenna 25 is reduced to zero near the point of connection between it and the housing 11, the antenna is insusceptible to the influence of the housing 11 and hence is excellent in radiation pattern characteristic accordingly.

In the case where the antenna is formed by elements provided on both sides of the dielectric plate 21 as depicted in FIG. 2, the width of the dielectric plate 21 can be reduced. The provision of the third strip antenna elements brings about two resonance frequencies, providing a wide band characteristic.

Furthermore, according to the present invention, the antenna can be retracted into the housing 11 and, at its retracted position, the antenna operates as a quarter-wave monopole antenna or half-wave dipole antenna and has a high gain and is connected to the radio circuit 12 at a low impedance.

It will be apparent that many modifications and variations may be effected without departing from the scope of the novel concepts of the present invention.

What is claimed is:

1. A portable radio unit comprising:

a housing;

a radio circuit provided in said housing;

a dielectric plate secured at one end to said housing and protrusively provided thereon;

a first strip antenna element formed on said dielectric plate and extending lengthwise thereof from said one end toward the other end of said plate and having an electrical length approximately equal to a quarter of the working wavelength;

a second antenna element having a coil provided on said dielectric plate at the side opposite from said housing with respect to said first strip antenna element;

a parallel twin-lead feeder formed on said dielectric plate and extending to said one end and connected at one end of said parallel twin-lead feeder to adjacent inner ends of said first and second antenna elements; and a second feeder connected between the other end of said parallel twin-lead feeder and said radio circuit.

2. A portable radio unit comprising:

a housing;

a radio circuit provided in said housing;

a dielectric plate secured at one end to said housing and protrusively provided thereon;

a first strip antenna element formed on said dielectric plate and extending lengthwise thereof from said one end toward the other end of said plate and having an electrical length approximately equal to a quarter of the working wavelength;

a second antenna element formed in a zigzag configuration on said dielectric plate at the side opposite from said housing with respect to said first strip antenna element;

a parallel twin-lead feeder formed on said dielectric plate and connected at one end of said parallel twin-lead feeder to adjacent inner ends of said first and second antenna elements; and a second feeder connected between the other end of said parallel twin-lead feeder and said radio circuit.

3. The portable radio unit of claim 1 or 2, wherein said first strip antenna element and one of lines of said parallel twin-lead feeder connected thereto are formed on one side of said dielectric plate and the other line of said parallel twin-lead feeder is formed on the other side of said dielectric plate.

4. The portable radio unit of claim 1 or 2 wherein a third strip antenna element of a length different from that of said first strip antenna element is formed on said dielectric plate substantially in parallel to said first strip antenna element and connected thereto at the side opposite from said housing.

5. The portable radio unit of claim 1 or 2 wherein said dielectric plate is retractable into said housing, one end of said second feeder making sliding contact with said parallel twin-lead feeder, and when said dielectric plate is at its fully retracted position in said housing, said second feeder is connected to the vicinity of the point of connection between said first and second antenna elements and said parallel twin-lead feeder.

6. The portable radio unit of claim 5, wherein said housing is made of conductive material and when said dielectric plate is at its fully retracted position in said housing, said second feeder is out of contact with said first antenna element.

7. The portable radio unit of claim 5, wherein short-circuit means is provided to electrically short two lines of said parallel twin-lead feeder at its inner end when said dielectric plate is at its fully retracted position in said housing.

8. The portable radio unit of claim 1 or 2 wherein said second antenna element is extended straight in a direction opposite to said first strip antenna element and the length of said second antenna element is about the same as the length of said first strip antenna element.

* * * * *